US007238119B2

(12) United States Patent
Roach et al.

(10) Patent No.: US 7,238,119 B2
(45) Date of Patent: Jul. 3, 2007

(54) GOLF CLUB HEAD WITH UNDERCUT

(75) Inventors: Ryan L. Roach, Cardiff-by-the-sea, CA (US); Christopher B. Best, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/828,209

(22) Filed: Apr. 21, 2004

(65) Prior Publication Data

US 2005/0239572 A1 Oct. 27, 2005

(51) Int. Cl.
*A63B 53/04* (2006.01)

(52) U.S. Cl. ..... 473/350; 473/332

(58) Field of Classification Search ..... 473/324–350
See application file for complete search history.

(56) References Cited

U.S. PATENT DOCUMENTS

| | | | | |
|---|---|---|---|---|
| 4,964,640 | A | 10/1990 | Nakanishi et al. | 473/335 |
| 5,924,939 | A | 7/1999 | Grace et al. | 473/324 |
| 6,524,196 | B1 * | 2/2003 | Yeh | 473/324 |
| 6,554,722 | B2 * | 4/2003 | Erickson et al. | 473/334 |
| 6,592,468 | B2 | 7/2003 | Vincent et al. | 473/334 |
| 6,592,469 | B2 * | 7/2003 | Gilbert | 473/350 |
| 6,616,547 | B2 | 9/2003 | Vincent et al. | 473/334 |
| 6,709,345 | B2 * | 3/2004 | Iwata et al. | 473/291 |
| 6,719,641 | B2 * | 4/2004 | Dabbs et al. | 473/291 |
| 6,811,496 | B2 * | 11/2004 | Wahl et al. | 473/334 |
| 6,902,495 | B2 * | 6/2005 | Pergande et al. | 473/332 |
| 2003/0022729 | A1 | 1/2003 | Pergande et al. | 473/332 |
| 2003/0092502 | A1 | 5/2003 | Pergande et al. | 473/332 |
| 2003/0228928 | A1 * | 12/2003 | Yabu | 473/290 |
| 2004/0043830 | A1 * | 3/2004 | Imamoto | 473/332 |

FOREIGN PATENT DOCUMENTS

| | | | |
|---|---|---|---|
| JP | 10234897 A | * | 9/1998 |
| JP | 2001190720 A | * | 7/2001 |

* cited by examiner

*Primary Examiner*—Eugene Kim
*Assistant Examiner*—Alvin A. Hunter, Jr.
(74) *Attorney, Agent, or Firm*—Bingham McCutchen LLP

(57) ABSTRACT

A golf club head having an undercut is disclosed. The club head includes a body defining a striking face, a top line, a sole, a back, a heel, and a toe. The back contains a cavity that extends in a direction substantially perpendicular to the face. A recesses is provided within the cavity, with the recess extending away from the cavity and toward the sole. The recess causes more of the club head mass to be oriented towards the perimeter of the club head. This enlarges the club sweet spot and increases the moment of inertia, producing a more forgiving club. The recess may have a varying depth and/or a varying draft angle. A rear wall of the recess may be provided with a cutout to further reposition mass toward the club head perimeter. An insert, such as a vibration dampening member, may be provided within the recess. The insert may contain secondary inserts, such as weight members, therein in strategic locations. The insert may completely fill the recess, or may fill only a portion thereof.

73 Claims, 9 Drawing Sheets

GOLF CLUB HEAD WITH UNDERCUT

BACKGROUND OF THE INVENTION

1. Field of the Invention

The present invention relates to a golf club head, and, more particularly, to a golf club head having an undercut.

2. Description of the Related Art

Iron-type golf clubs generally include a front or striking face, a top line, and a sole. The front face interfaces with and strikes the golf ball. A plurality of score lines or grooves is positioned on the face to assist in imparting spin to the ball. The top line is generally configured to have a particular look to the golfer and to provide weight. The sole of the golf club is particularly important to the golf shot because it contacts and interacts with the ground during the swing.

In conventional sets of iron-type golf clubs, each club includes a shaft with a club head attached to one end and a grip attached to the other end. The club head includes a face for striking a golf ball. The angle between the face and a vertical plane is called the loft angle.

The set generally includes irons that are designated number 2 through number 9, and a pitching wedge. Other wedges, such as a lob wedge, a gap wedge, and a sand wedge, may be optionally included with the set. Each iron has a shaft length that usually decreases through the set as the loft for each club head increases from the long irons to the short irons. The length of the club, along with the club head loft and center of gravity location, impart various performance characteristics to the ball's launch conditions upon impact and determine the distance the ball will travel. Flight distance generally increases with a decrease in loft angle and an increase in club length. However, difficulty of use also increases with a decrease in loft angle and an increase in club length.

Iron-type golf clubs generally can be divided into two categories: blades and cavity backs. Blades are traditional clubs with a substantially uniform appearance from the sole to the top line, although there may be some tapering from sole to top line.

Since blade designs have a small sweet spot (that is, the area of the face that results in a desirable golf shot upon striking a golf ball), they are relatively difficult to use and are therefore typically only used by skilled golfers. However, these clubs have the benefit of producing longer golf shots than other designs. Furthermore, since these designs are typically made of relatively soft forged steel, they allow the golfer to work the ball and shape the golf shot as desired.

Cavity backs are modern designs that move some of the club mass to the perimeter of the club by providing a hollow or cavity in the back of the club, opposite the striking face. This produces a more forgiving club with a larger sweet spot. Moving weight to the perimeter allows the size of the club face to be increased, also resulting in a larger sweet spot. The perimeter weighting created by the cavity also increases the club's moment of inertia, which is a measurement of the club's resistance to torque, for example the torque resulting from an off-center hit. These clubs are easier to hit than blades, and are therefore usable by less-skilled and beginner golfers.

Other known golf clubs achieve a desired balance or moment of inertia by adding a weight to the club. These clubs typically add a weight member to the bottom surface of the sole, in the center thereof.

SUMMARY OF THE INVENTION

The present invention relates to a golf club head having an undercut. The club head includes a body defining a striking face, a top line, a sole, a back, a heel, and a toe. The back contains a cavity that extends in a direction substantially perpendicular to the face. A recess is provided within the cavity, with the recess extending away from the cavity and toward the sole. The recess causes more of the club head mass to be oriented towards the perimeter of the club head. This enlarges the club sweet spot and increases the moment of inertia, producing a more forgiving club. The golf club head preferably is an iron-type golf club head.

To further move mass towards the club head perimeter, the recess may have a varying depth. If so, the recess includes a heel portion including a first depth, a toe portion including a second depth, and a central portion intermediate the heel and toe portions including a third depth. The third depth is greater than the first and second depths, displacing mass away from the center of the club head and toward the perimeter of the club head. The first and second depths may be substantially equal, or they may be different. If the golfer tends to hook the ball, the first depth is greater than the second depth, which places more mass toward the toe of the club. If the golfer tends to slice the ball, the first depth is less than the second depth, which places more mass toward the heel of the club. In any event, the third depth is preferably from approximately 0.05 inch to approximately 1 inch. The recess depth may preferably be varied throughout the clubs in the set. Since longer clubs are more difficult to use, the recess is more accentuated for the long irons than for the short irons. Preferred depths for the short irons include from approximately 0.05 inch to approximately 0.5 inch, and preferred depths for the middle and long irons include from approximately 0.2 inch to approximately 1 inch.

An additional measure to displace club head mass to the perimeter includes providing a varying draft angle. The draft angle is the angle within the recess between the front and back walls of the recess. These walls, which are the club head back and a rear wall, define the recess. The heel portion of the recess includes a first draft angle, the toe portion includes a second draft angle, and the central portion includes a third draft angle. The third draft angle is greater than the first and second draft angles, further displacing mass from the central region to the perimeter of the club head and increasing the moment of inertia. The first and second draft angles may be substantially equal, or they may be different. If the golfer tends to hook the ball, the first draft angle is greater than the second draft angle, which places more mass toward the toe of the club. If the golfer tends to slice the ball, the first draft angle is less than the second draft angle, which places more mass toward the heel of the club. In any event, the first and second draft angles preferably are from approximately 5° to approximately 25°, more preferably from approximately 20° to approximately 25°, and the third draft angle preferably is from approximately 30° to approximately 45°, more preferably from approximately 35° to approximately 40°.

The recess may further include a supplemental portion intermediate the central and toe portions having a fourth draft angle. The fourth draft angle preferably is greater than the third draft angle. A preferred range for the fourth draft angle is from approximately 35° to approximately 60°, more preferably from approximately 35° to approximately 50°.

The rear wall may be curved outward in a central portion thereof, which has a similar effect as a varying draft angle.

The club head may be provided with both a varying recess depth and a varying recess draft angle, thereby providing multiple means of displacing mass from the center of the club head to the perimeter of the club head.

To further displace mass towards the club head perimeter, the rear wall may contain a cutout in a central portion thereof. An indicia, such as a logo or other identifying mark, may be provided on the back of the club head. The cutout is preferably aligned with the indicia such that the indicia is visible through the cutout. The cutout may take any desired shape. Preferred shapes include, for example, circular, elliptical, oval, triangular, and trapezoidal. The cutout does not have to contain the entire shape. Rather, the cutout may take on only a portion of a shape. For example, the cutout may be, at least in part, a trapezoid, such that the cutout takes on the appearance of a chevron. A preferred circular shape has a diameter substantially equal to the diameter of a golf ball, which may be 1.68 inches.

An insert, such as a weight member or a dampening member or a medallion, may be positioned within the recess. The insert may be secured within the recess using an adhesive and/or a mechanical fastener. Preferred dampening materials, which diminish vibrations in the club head, including vibrations generated during an off-center hit, include urethane and rubber. The insert may completely fill the recess, or may fill only a portion thereof. The insert may include a main body with a top surface and legs extending away from the top surface toward the bottom of the recess. The legs may or may not extend all the way to the bottom of the recess. The insert is aligned with the top of the recess to provide a clean look to the golf club head.

The insert is configured according to the recess in which it will be used. If the recess has a varying depth, the insert will have a varying depth corresponding to the recess depths. Following the discussion above regarding the recess depths, the insert includes a heel portion including a first depth corresponding to the recess first depth, a toe portion including a second depth corresponding to the recess second depth, and a central portion intermediate the heel and toe portions including a third depth corresponding to the recess third depth. Likewise, if the recess has a varying draft angle, the insert will have a varying width corresponding to the recess widths, which are a function of the recess draft angles. Following the discussion above regarding the recess draft angle, the insert includes a heel portion including a first width corresponding to the recess first width, a toe portion including a second width corresponding to the recess second width, and a central portion intermediate the heel and toe portions including a third width corresponding to the recess third width. If the recess has a cutout, the insert will have a corresponding cutout such that the insert is substantially aligned with the top surface of the rear wall.

If an indicia is provided on the back of the club head, the insert may be provided with a hole therethrough. The hole is aligned with the indicia such that the indicia is visible through the hole. Alternatively, the insert is substantially translucent and the indicia is visible through the insert without requiring a hole. As another alternative, the insert may include an indentation therein and a second insert may be attached to the insert within the indentation. In this case, the second insert may contain an indicia thereon. To hold the second insert securely in place, the insert may contain a counterbore and the second insert may be attached to the insert within the counterbore. The second insert is preferably adapted to be locked in place within the counterbore, such as with a tongue and groove arrangement.

A plate may be attached to the insert, preferably to the top of the insert. The plate may contain perforations, such as elongated slots. The elongated slots may be arranged such that they are substantially parallel to a longitudinal axis of the golf club head, such that they are substantially perpendicular to a longitudinal axis of the golf club head, or askew to a longitudinal axis of the golf club head. If perforations are included, the insert and the plate preferably are of differing colors such that the insert will be visible through the perforations. Optionally, the plate may contain an indicia thereon. The plate may be formed, at least in part, of one or more of metal, plastic, urethane, or a composite. Alternatively, the insert is a multilayer insert including a first insert layer and a second insert layer. The insert layers may be of differing materials, and preferably have different stiffnesses. This setup allows one of the insert layers to absorb vibrations and the other insert layer to help provide a solid feel to the golf club. The layers may be arranged in any desirable manner, with a preferred arrangement being the more resilient layer being placed within a lower portion of the recess and the stiffer layer being attached atop the more resilient layer. Alternatively, the positioning of the layers can be reversed. The top layer may also include perforations therein, as previously discussed.

The insert may contain one or more secondary inserts, such as weight members, therein. In one arrangement, a weight member is positioned in a central portion of the insert. In another arrangement, a first weight member is positioned in a heel portion of the insert, and a second weight member is positioned in a toe portion of the insert. The first and second weight members may be of substantially the same mass, or they may be of differing masses. If the golfer tends to hook the ball, the toe weight member may be of greater mass than the heel weight member. If the golfer tends to slice the ball, the heel weight member may be of greater mass than the toe weight member.

The recess may be divided into an upper portion and a lower portion, with the insert being positioned within the upper portion and the lower portion remaining hollow. The relative volumes of the upper and lower portions may be designed to produce clubs with different feels. In a preferred arrangement, the upper portion volume is less that the lower portion volume. The lower portion volume may desirably be at least two times the upper portion. The upper volume may be provided with one or more ledges along a lower boundary thereof to facilitate retention of the insert within the upper volume.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft angles and others in the following portion of the specification may be read as if prefaced by the word "about" even though the term "about" may not expressly appear with the value, amount or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
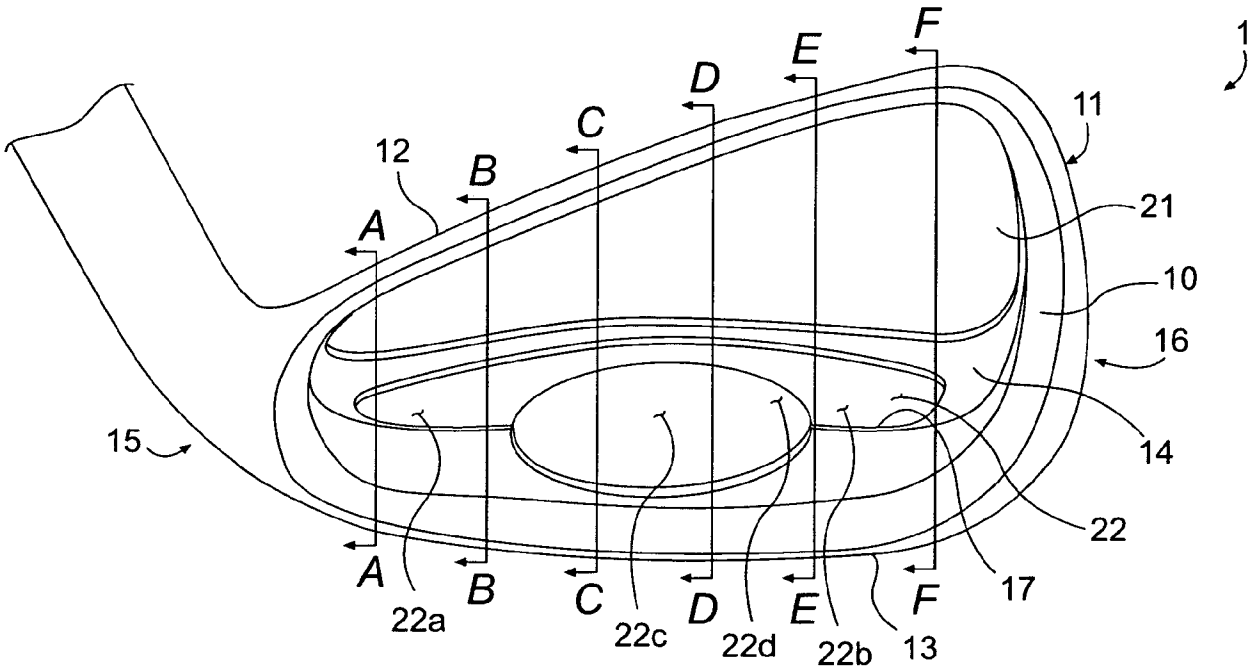
FIG. 1 shows a golf club head of the present invention.

FIG. 1 shows a first golf club head 1 of the present invention. The golf club head 1 includes a body 10 defining a striking face 11, a top line 12, a sole 13, a back 14, a heel 15, and a toe 16. The back 14 contains a cavity 21 and a recess 22. The cavity 21 extends in a direction substantially perpendicular to the face 11, and the recess 22 extends away from the cavity 21 and toward the sole 13. Preferably, the club head 1 is an iron-type golf club head.

The recess 22 removes material from the central portion of the club head 1, which inherently provides more of the club head mass towards the perimeter of the club head 1, producing a greater moment of inertia (MOI) measured about a vertical axis passing through the club head center of gravity and increasing the size of the club head sweet spot. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits. Moving or rearranging mass to the club head perimeter enlarges the sweet spot and produces a more forgiving club. To increase this effect, the recess 22 has a varying depth. The recess 22 includes a heel portion 22*a* including a first depth, a toe portion 22*b* including a second depth, and a central portion 22*c* intermediate the heel and toe portions 22*a*, 22*b* including a third depth. The third depth is greater than the first and second depths, displacing more mass to the perimeter of the club head 1. The first and second depths may be substantially equal. Alternatively, the relative depths of the recess 22 may be different. In a first alternative, the first depth is greater than the second depth, which places more mass toward the toe 16. This may be desired for a golfer that tends to hook the ball, since biasing the club head center of gravity toward the toe 16 makes it harder to close, decreasing the likelihood of closing the club head too soon or too much at impact. In a second alternative, the first depth is less than the second depth, which places more mass toward the heel 15. This may be desired for a golfer that tends to slice the ball, since biasing the club head center of gravity toward the heel 15 makes it easier to close, decreasing the likelihood of leaving the club head open at impact.

The third depth preferably is from approximately 0.05 inch to approximately 1 inch. As stated above, difficulty of golf club use increases with a decrease in loft angle and an increase in club length. In other words, difficulty of use increases from the short irons to the long irons. It may therefore be desirable to provide increasing alteration with an increase in difficulty of use. The recess 22 may be shaped differently for each club in the set or for different groups of clubs within the set. In this instance, the recess 22 is more accentuated for the long irons than for the short irons. Preferred depths for the short irons include from approximately 0.05 inch to approximately 0.5 inch, and preferred depths for the middle and long irons include from approximately 0.2 inch to approximately 1 inch.

The recess 22 preferably also has a variable draft angle $\alpha$ as an additional mode of enlarging the sweet spot and producing a more forgiving club. The draft angle $\alpha$ is the angle within the recess 22 between the club head back 14 and a rear wall 17, which define the recess 22. The heel portion 22*a* includes a first draft angle, the toe portion 22*b* includes a second draft angle, and the central portion 22*c* includes a third draft angle, where the third draft angle is greater than the first and second draft angles. In other words, the central portion of the recess 22 has a greater width than the heel and toe portions This further displaces mass from the central region to the perimeter of the club head 1 and increases the MOI. The first and second draft angles may be substantially equal. Alternatively, the relative draft angles of the recess 22 may be different. In a first alternative, the first draft angle is greater than the second draft angle, which places more mass toward the toe 16. This may be desired for a golfer that tends to hook the ball, since biasing the club head center of gravity toward the toe 16 makes it harder to close, decreasing the likelihood of closing the club head too soon or too much at impact. In a second alternative, the first draft angle is less than the second draft angle, which places more mass toward the heel 15. This may be desired for a golfer that tends to slice the ball, since biasing the club head center of gravity toward the heel 15 makes it easier to close, decreasing the likelihood of leaving the club head open at impact. The first and second draft angles preferably are from approximately 5° to approximately 25°, more preferably from approximately 20° to approximately 25°, and the third draft angle preferably is from approximately 30° to approximately 45°, more preferably from approximately 35° to approximately 40°.

Optionally, the recess 22 includes a supplemental portion intermediate the central and toe portions 22*c*, 22*b*, such as near cross-section D—D. This supplemental portion has a fourth draft angle and, preferably, the fourth draft angle is greater than the third draft angle. A preferred range for the fourth draft angle is from approximately 35° to approximately 60°, more preferably from approximately 35° to approximately 50°.

Figure 2:
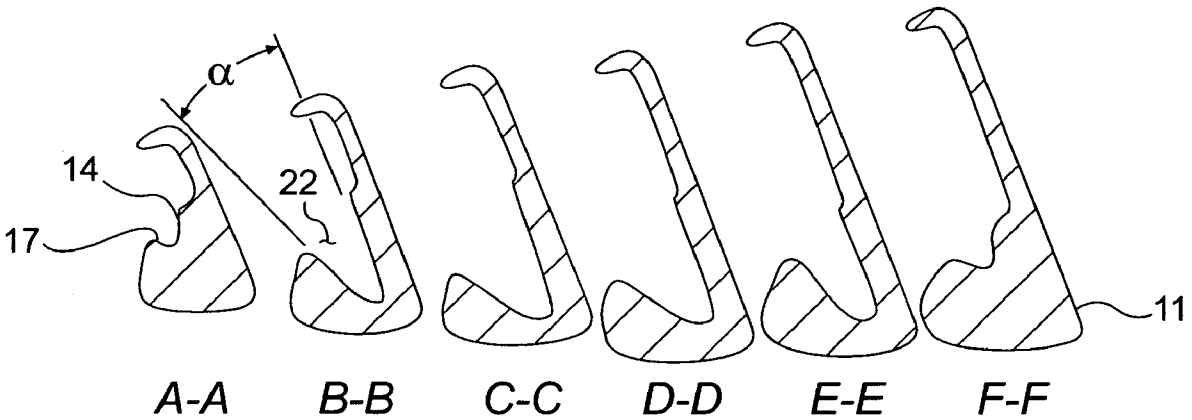
FIG. 2 shows several cross-sectional views through the golf club head of FIG. 1.

FIG. 2 shows several cross-sectional views through the golf club head 1. The cross-sections are taken through multiple locations through the club head 1, from the heel portion 22*a*, through the central portion 22*c*, to the toe portion 22*b*. Cross-section A—A is through the heel portion 22*a* of the club head 1, cross-section F—F is through the toe portion 22*b* of the club head 1, and cross-sections C—C and D—D are through the central portion 22*c*. The cross-sections illustrate the removal of mass from the club head 1 via the recess 22, with more material being removed from the central region than from the toe and heel regions.

Figure 3:
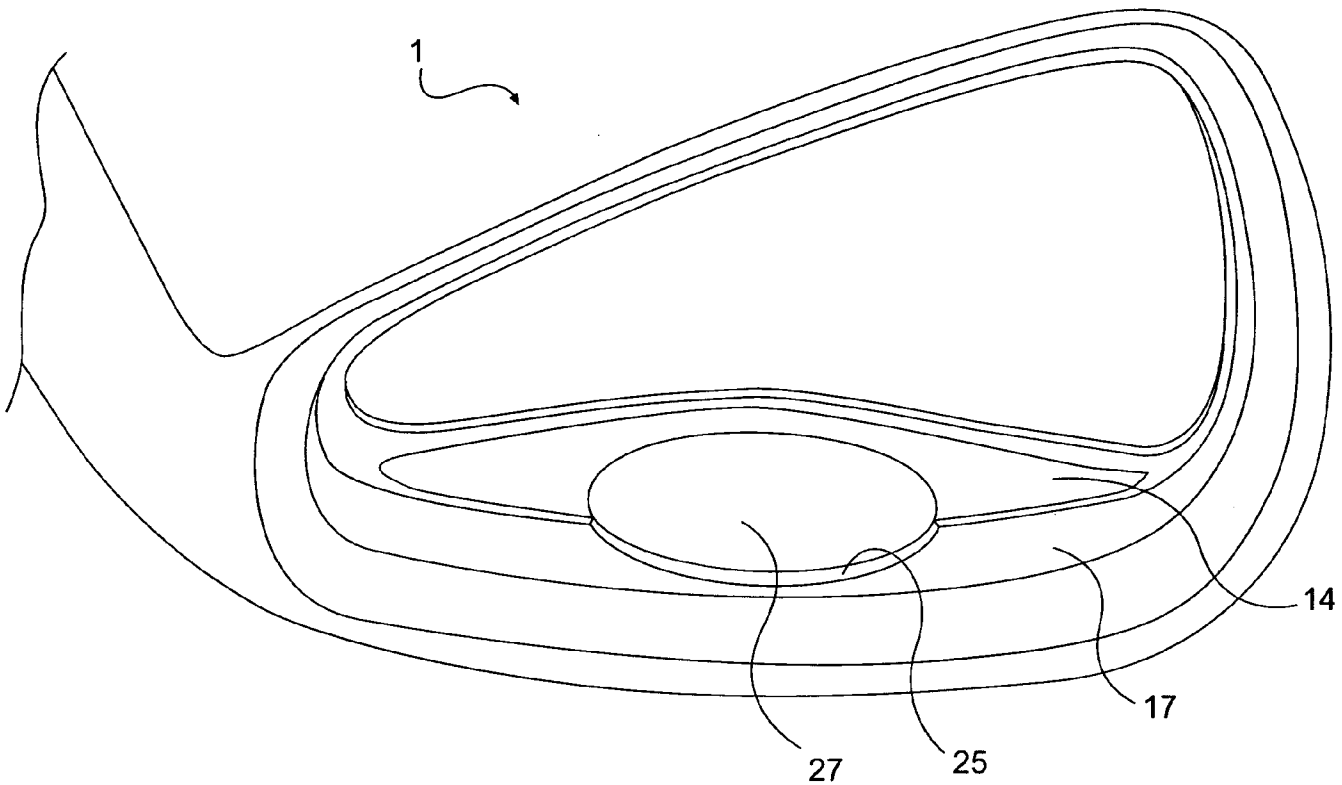
FIG. 3 shows a golf club of the present invention illustrating a cutout feature.

The rear wall 17 may contain a cutout therein. FIG. 3 shows a golf club of the present invention illustrating this feature. As illustrated, rear wall 17 contains a cutout 25 from a central portion thereof. This cutout 25 further removes mass from the center of the club head 1, additionally biasing the mass location to the perimeter. The club head 1 may include an indicia 27, preferably on the back 14 of the club head 1. This indicia 27 may be, for example, a logo or other identifying mark. If an indicia 27 is included, it and the cutout 25 preferably are aligned such that one may view the indicia 27 through the cutout 25. The cutout 25 may take virtually any shape. Contemplated shapes include circular, elliptical, oval, triangular, and trapezoidal. Note that the cutout 25 does not have to contain the entire shape. Rather, the cutout 25 may take on only a portion of the aforementioned shapes. For example, the cutout 25 may be, at least in part, a trapezoid, such that the cutout 25 takes on the appearance of a chevron. A preferred circular shape has a diameter substantially equal to the diameter of a golf ball, which may be 1.68 inches.

Figure 4:
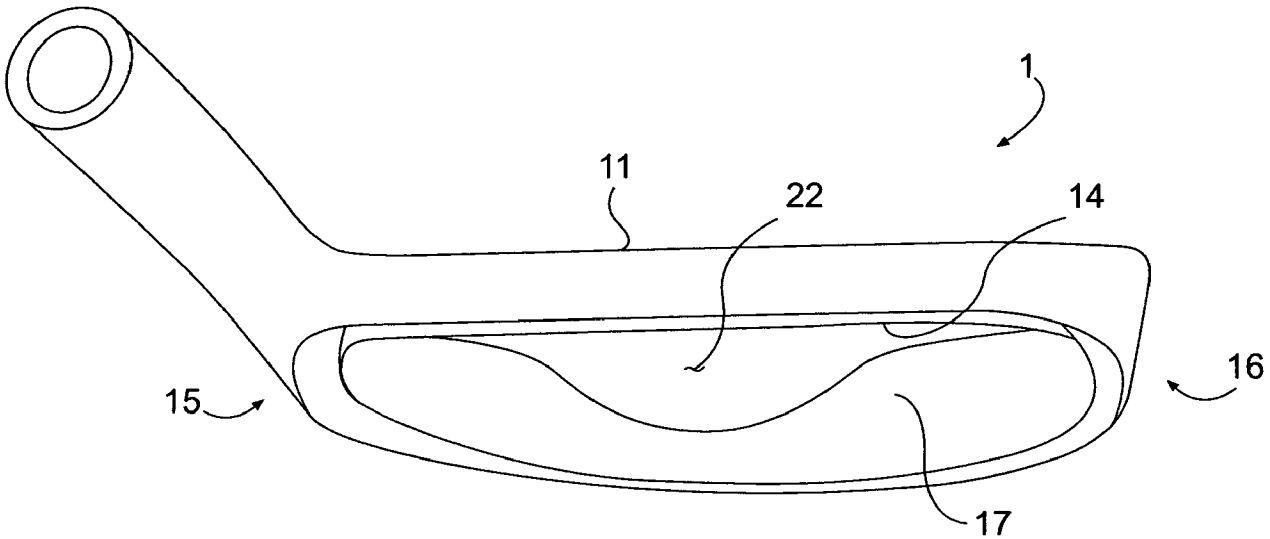
FIG. 4 shows a top view of the golf club of FIG. 3.

The rear wall 17 may be curved outward in a central portion thereof, which enhances perimeter weighting similarly to the increased central draft angle discussed above. FIG. 4 shows a top view of the golf club of FIG. 3, including a curved rear wall 17. The rear wall 17 curves outward in a central portion thereof. Since the toe and heel portions do not curve outward to the extent that the central portion does, there is more material and, therefore, more mass in the heel and toe portions of the club head 1, increasing the club head MOI.

The MOI about a vertical axis passing through the club head center of gravity preferably is greater than approximately 2300 $gm \cdot cm^2$. A preferred range of MOI values includes from approximately 2300 $gm \cdot cm^2$ to approximately 3000 $gm \cdot cm^2$. The MOI values will likely vary from club head to club head throughout the set.

Figure 5:
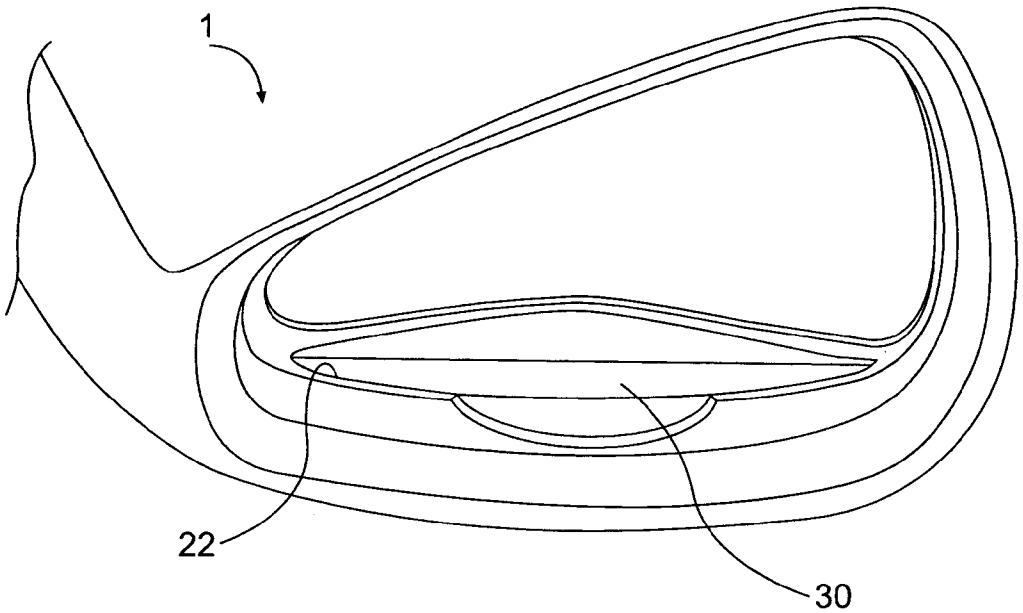
FIG. 5 shows a golf club of the present invention with an insert.

FIG. 5 shows a golf club 1 of the present invention with an insert 30 positioned within the recess 22. The insert 30 may completely fill the recess 22, or may fill only a portion thereof. The insert 30 may be coupled to the club head 1 by an adhesive. Mechanical fasteners, either alone or in conjunction with an adhesive, may also be used to couple the insert 30 to the club head body 10. Exemplary fasteners include screws and bolts. If used, the mechanical fastener(s) preferably extends upward from a bottom portion of the recess 22. The insert 30 may be any desirable type of insert, such as a weight member, a dampening member, a medallion, or a combination of two or more of these examples. Use of a dampening member is useful to diminish vibrations in the club head 1, such as those generated during an off-center hit, and enhances feel and performance of the club. Preferred dampening materials include urethane and rubber. Medallions are useful for providing brand and model information. The medallion may be made of plastic, such as co-molded plastic, or a metallic material, such as stainless steel, or any other appropriate material or composition.

Figure 6:
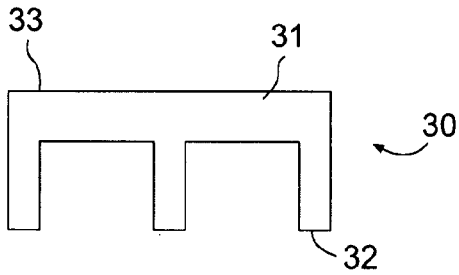
FIG. 6 shows an insert for use with a golf club of the present invention.

FIG. 6 shows a preferred form for the insert 30. The insert 30 includes a main body portion 31 and one or more legs 32 extending from the body 31. While three legs 32 are shown in the illustrated embodiment, any number of legs 32 may be included. The main body 31 includes a top surface 33 that preferably is aligned with the top of the recess 22. The legs 32 extend downward away from the top surface 33. The legs 32 may or may not extend all the way to the bottom of the recess 22. The legs 32 are optional; the insert 30 may alternatively be comprised of only a body member 31. The insert 30 may also include a lower body configured to conform to the bottom surface of the recess 22. This lower body may extend along the entire length of the recess 22 or only a portion thereof.

Figure 7:
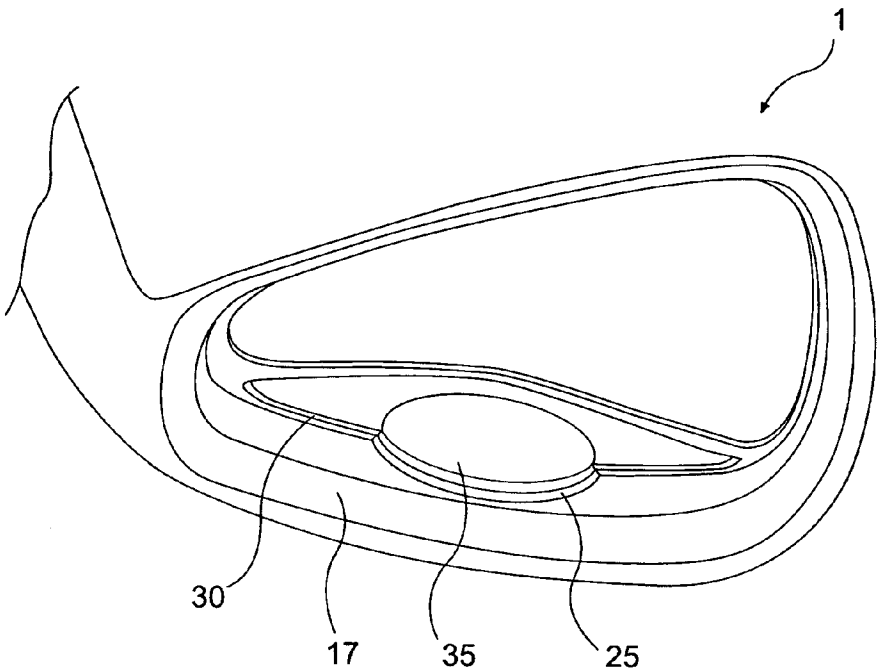
FIG. 7 shows a golf club of the present invention with an insert.

The insert 30 preferably is configured according to the recess 22 in which it will be used. If the recess 22 has a varying depth, the insert 30 will have a varying depth corresponding to the recess depths. Following the discussion above regarding the recess depths, the insert 30 includes a heel portion including a first depth corresponding to the recess first depth, a toe portion including a second depth corresponding to the recess second depth, and a central portion intermediate the heel and toe portions including a third depth corresponding to the recess third depth. Likewise, if the recess 22 has a varying draft angle, the insert 30 will have a varying width corresponding to the recess widths, which are a function of the recess draft angles. Following the discussion above regarding the recess draft angle, the insert 30 includes a heel portion including a first width corresponding to the recess first width, a toe portion including a second width corresponding to the recess second width, and a central portion intermediate the heel and toe portions including a third width corresponding to the recess third width. As illustrated in FIG. 7, if the recess 22 has a cutout 25, the insert 30 will have a corresponding cutout 35 such that the insert 30 is substantially aligned with the top surface of the rear wall 17.

Alternatively, the insert 30 is not configured to mirror the rear wall 17. For example, if the rear wall 17 includes a cutout 25, the insert 30 may be configured without a corresponding cutout such that the insert 30 extends above the rear wall 17 above the cutout 25. In this embodiment, the back 14 preferably contains an indicia 27 aligned with the cutout 25 and the insert 30 preferably is substantially translucent. This allows the indicia 27 to be seen through the insert 30, resulting in a golf club having a novel appearance.

Figure 8:
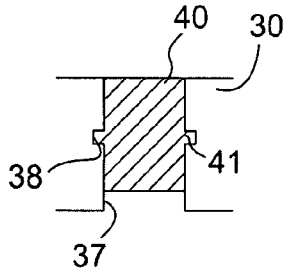
FIG. 8 shows an insert containing a counterbore and second insert for use with a golf club of the present invention.

The insert 30 may define a hole therethrough. This may be desirable if the club head body 10 has an indicia, such as a logo, thereon. The hole preferably is aligned with the indicia such that the indicia is visible through the hole. Alternatively, the insert 30 may include an indentation therein and a second insert may be coupled to the insert 30 within the indentation. In this case, the second insert may contain an indicia thereon. To hold the second insert securely in place, the insert 30 may contain a counterbore and the second insert may be coupled to the insert 30 within the counterbore. The second insert is preferably adapted to be locked in place within the counterbore. A preferred method of locking the second insert within the counterbore is shown in FIG. 8. FIG. 8 shows an insert 30 with a counterbore 37 therein. The counterbore 37 contains a groove 38 therein. A second insert 40 is positioned within the counterbore 37. The second insert 40 contains a tongue 41 that is configured to matingly engage the groove 38 and lock the second insert 40 within the insert 30. The material for the insert 30 preferably is soft to allow insertion into the groove 38. Preferably, the material of the insert 30 has a hardness less than approximately 80 Shore C.

A plate may optionally be coupled to the insert 30, preferably to the top surface 33 of the insert 30. The plate may be perforated, such as with elongated slots. If perforations are included, the insert 30 and the plate preferably are of differing colors such that the insert 30 will be visible through the perforations. Optionally, the plate may contain an indicia thereon. The plate may be formed, at least in part, of one or more of metal, plastic, urethane, or a composite.

Figure 9:
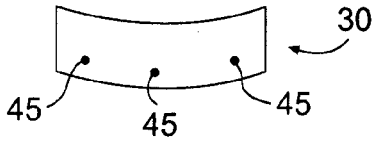
FIG. 9 shows an insert containing secondary inserts for use with a golf club of the present invention.

FIG. 9 shows an insert 30 containing secondary inserts 45 for use with a golf club of the present invention. While three such secondary inserts 45 are shown in the illustrated embodiment, any number of secondary inserts 45 may be included. The secondary inserts 45 may be weight members. The weight members may be of any desired weight, and preferably have a specific gravity greater than a specific gravity of the club head 1.

The weight members 45 may be positioned as desired within the insert 30. A first preferred configuration includes a weight member 45 positioned in a central portion of the insert 30, preferably toward the bottom thereof. This first configuration helps lower the club head center of gravity.

A second preferred configuration includes a first weight member 45 in a heel portion of the insert 30 and a second weight member 45 in a toe portion of the insert 30. In addition to lowering the club head center of gravity, this second configuration also increases the club head MOI. In the second configuration, the masses of the first and second weight members may either be substantially the same, or they may be different. If the golfer tends to slice the ball, it may be desirable to provide a heel weight member with a greater mass than the toe weight member. Conversely, if the golfer tends to hook the ball, it may be desirable to provide a heel weight member with a lesser mass than the toe weight member.

Figure 10:
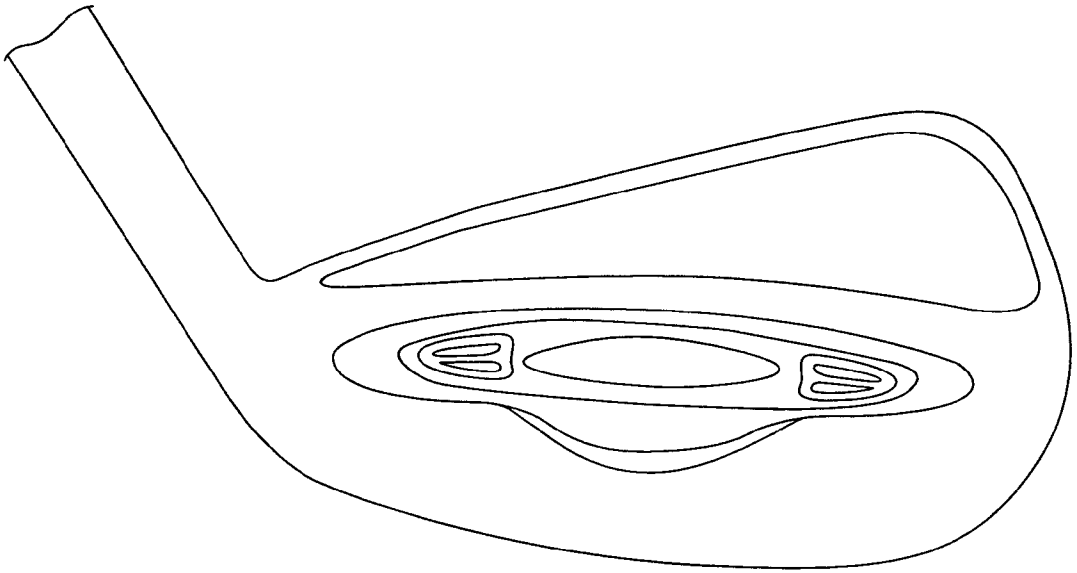
FIG. 10 shows a golf club head of the present invention with a multilayer insert.

In another embodiment, the insert 30 is a multilayer insert. The insert 30 includes a first insert layer of a first material having a first stiffness, and a second insert layer of a second material having a second stiffness. Preferably, the first insert layer is coupled to the back 14 on a rear side of the face 11 and the second insert layer is coupled to the first insert layer. The second insert layer may be coupled to the first insert layer along any portion thereof, but preferably is coupled to the top surface 33 of the first insert layer. The second insert layer may contain perforations therein, which may be in the form of elongated slots, to allow the first insert layer to be seen therethrough. The elongated slots may be aligned substantially parallel to the longitudinal axis of the golf club head 1, substantially perpendicular to the longitudinal axis of the golf club head 1, or askew to the longitudinal axis of the golf club head 1. The first and second insert layers are preferably of substantially different colors. These inserts 30 may be formed by a double-shot manufacturing process, and may be formed of urethane, polyurethane, or any other desired material, where the insert 30 is formed in a dual injection process. U.S. Pat. No. 5,924,939 to Grace et al., the disclosure of which is incorporated herein in its entirety, discloses additional inserts that may be used with the present invention. FIG. 10 shows a golf club head 1 with a multilayer insert. The second insert layer has perforations therein, allowing the first insert layer to be visible.

The relative stiffnesses of the first and second insert layers affect the feel of the club. The first stiffness is preferably less than the second stiffness. This setup allows the first insert layer to absorb vibrations, while the second insert layer helps provide a solid feel to the golf club. Alternatively, the first stiffness is greater than the second stiffness and the first insert layer primarily provides stability while the second insert layer primarily absorbs vibrations.

Figure 11:
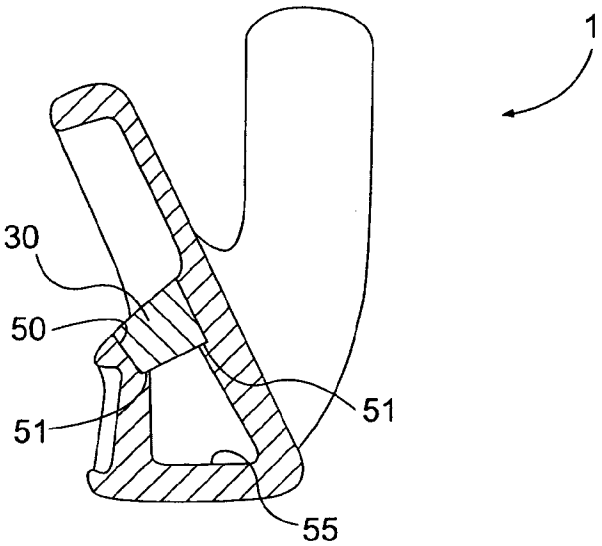
FIG. 11 shows a cross-sectional view through a central portion of a golf club head of the present invention.

FIG. 11 shows a cross-sectional view through a central portion of a golf club head 1 of the present invention. In this embodiment, the recess 22 includes an upper portion 50 having a first volume and a lower portion 55 having a second volume. The insert 30 is positioned within the upper portion 50 and, preferably, substantially fills the upper portion 50. To facilitate positioning of the insert 30 within the upper portion 50, the club head optionally may contain one or more ledges 51 at a lower boundary thereof. These ledges 51 provide a seat upon which the insert 30 may be positioned and to which the insert 30 may be coupled.

Preferably, the lower portion 55 is substantially hollow. Having a hollow lower volume helps produce a more forgiving club with a larger sweet spot. The second volume preferably is greater than the first volume, and more preferably is almost two times the first volume. Preferred volumes for the lower portion 55 include approximately 0.1 $in^3$ to approximately 0.4 $in^3$, with approximately 0.15 $in^3$ to approximately 0.25 $in^3$ being more preferred. Preferred volumes for the upper portion 50 include approximately 0.1 $in^3$ to approximately 0.2 $in^3$, with approximately 0.14 $in^3$ to approximately 0.15 $in^3$ being more preferred. These volumes will likely vary from club head to club head throughout the set.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A golf club head, comprising:

a body defining a striking face, a top line, a sole, a back, a heel, and a toe; wherein:

said back contains a cavity and a recess, said cavity extending in a direction substantially perpendicular to said face, said recess extending away from said cavity and toward said sole;

said recess has a varying depth and a varying draft angle;

said recess includes a heel portion including a first draft angle, a toe portion including a second draft angle, and a central portion intermediate said heel and toe portions including a third draft angle; and said third draft angle is greater than said first and second draft angles.

2. The golf club head of claim 1, wherein:

said recess includes a heel portion including a first depth, a toe portion including a second depth, and a central portion intermediate said heel and toe portions including a third depth; and said third depth is greater than said first and second depths.

3. The golf club head of claim 2, wherein said first and second depths are substantially equal.

4. The golf club head of claim 2, wherein said first depth is greater than said second depth.

5. The golf club head of claim 2, wherein said first depth is less than said second depth.

6. The golf club head of claim 2, wherein said third depth is from approximately 0.05 inch to approximately 1 inch.

7. The golf club head of claim 6, wherein the golf club head is a short iron-type golf club head, and said third depth is from approximately 0.05 inch to approximately 0.5 inch.

8. The golf club head of claim 6, wherein the golf club head is a middle or long iron-type golf club head, and said third depth is from approximately 0.2 inch to approximately 1 inch.

9. The golf club head of claim 1, wherein said first and second draft angles are substantially equal.

10. The golf club head of claim 1, wherein:

said first and second draft angles are from approximately 5° to approximately 25°; and said third draft angle is from approximately 30° to approximately 45°.

11. The golf club head of claim 10, wherein:

said first and second draft angles are from approximately 20° to approximately 25°; and said third draft angle is from approximately 35° to approximately 40°.

12. The golf club head of claim 1, wherein:

said recess further includes a supplemental portion intermediate said central and toe portions having a fourth draft angle; and said fourth draft angle is greater than said third draft angle.

13. The golf club head of claim 12, wherein:

said first and second draft angles are from approximately 5° to approximately 25°;

said third draft angle is from approximately 30° to approximately 45°; and said fourth draft angle is from approximately 35° to approximately 60°.

14. The golf club head of claim 1, wherein:

said heel portion includes a first depth, said toe portion includes a second depth, and said central portion includes a third depth; and said third depth is greater than said first and second depths.

15. The golf club head of claim 1, wherein said recess is between and defined by said back and a rear wall.

16. The golf club head of claim 15, wherein said rear wall contains a cutout in a central portion thereof.

17. The golf club head of claim 16, further including an indicia on said back and wherein said cutout is aligned with said indicia.

18. The golf club head of claim 16, wherein said cutout has a shape, at least in part, selected from the group consisting of circular, elliptical, oval, triangular, and trapezoidal.

19. The golf club head of claim 16, wherein said cutout has a substantially circular shape with a diameter substantially equal to the diameter of a golf ball.

20. The golf club head of claim 19, wherein said diameter is approximately 1.68 inches.

21. The golf club head of claim 15, wherein said rear wall is curved outward in a central portion thereof.

22. The golf club head of claim 1, wherein the club head has a center of gravity and a moment of inertia measured about a vertical axis passing through said center of gravity greater than approximately 2300 $gm \cdot cm^2$.

23. The golf club head of claim 22, wherein said moment of inertia is from approximately 2300 $gm \cdot cm^2$ to approximately 3000 $gm \cdot cm^2$.

24. A golf club head, comprising:

a body defining a striking face, a top line, a sole, a back, a heel, and a toe; wherein:

said back contains a cavity and a recess, said cavity extending in a direction substantially perpendicular to said face, said recess extending away from said cavity and toward said sole; and an insert positioned within said recess;

wherein said recess includes a heel portion including a first width, a toe portion including a second width, and a central portion intermediate said heel and toe portions including a third width;

wherein said third width is greater than said first and second widths;

wherein said recess includes an upper portion and a lower portion, and said insert is positioned within said upper portion; and wherein said insert includes a heel portion including a first width corresponding to said recess first width, a toe portion including a second width corresponding to said recess second width, and a central portion intermediate said heel and toe portions including a third width corresponding to said recess third width.

25. The golf club head of claim 24, wherein said insert is a dampening member.

26. The golf club head of claim 24, wherein said insert is formed, at least in part, of urethane or rubber.

27. The golf club head of claim 24, wherein said insert contains a top surface and includes legs that extend away from top surface toward a bottom of said recess.

28. The golf club head of claim 27, wherein said legs do not extend to said bottom.

29. The golf club head of claim 27, wherein said insert contains at least three legs.

30. The golf club head of claim 27, wherein said top surface is aligned with a top of said recess.

31. The golf club head of claim 24, wherein:

said heel portion includes a first depth, said toe portion includes a second depth, and said central portion includes a third depth; and said third depth is greater than said first and second depths.

32. The golf club head of claim 31, wherein said insert includes a heel portion including a first depth corresponding to said recess first depth, a toe portion including a second depth corresponding to said recess second depth, and a central portion intermediate said heel and toe portions including a third depth corresponding to said recess third depth.

33. The golf club head of claim 24, wherein:

said recess is between and defined by said back and a rear wall, said rear wall containing a cutout in a central portion thereof; and said insert contains a cutout in an upper surface thereof, said insert cutout being aligned with said recess cutout.

34. The golf club head of claim 33, further including an indicia on said back and wherein said cutouts are aligned with said indicia.

35. The golf club head of claim 24, wherein said insert defines a hole therethrough.

36. The golf club head of claim 35, further including an indicia on said back and wherein said hole is aligned with said indicia.

37. The golf club head of claim 24, wherein said insert contains an indentation therein and further comprising an second insert coupled to said insert within said indentation.

38. The golf club head of claim 37, wherein said second insert contains an indicia thereon.

39. The golf club head of claim 37, wherein said insert contains a counterbore and said second insert is coupled to said insert within said counterbore.

40. The golf club head of claim 39, wherein said second insert is adapted to be locked in place within said counterbore.

41. The golf club head of claim 24, wherein said insert is coupled to the club head by an adhesive.

42. The golf club head of claim 41, wherein said insert is further coupled to the club head by a mechanical fastener.

43. The golf club head of claim 42, wherein said mechanical fastener extends upward from a bottom of said recess.

44. The golf club head of claim 24, further comprising a plate coupled to said insert.

45. The golf club head of claim 44, wherein said plate is coupled to a top of said insert.

46. The golf club head of claim 44, wherein said plate is perforated.

47. The golf club head of claim 44, wherein said plate is formed, at least in part, of one or more of metal, plastic, urethane, or a composite.

48. The golf club head of claim 24, wherein said insert is substantially translucent.

49. The golf club head of claim 48, wherein:

said recess is between and defined by said back and a rear wall, said rear wall containing a cutout in a central portion thereof;

said back contains an indicia thereon; and said cutout and said insert are aligned with said indicia such that said indicia is visible through said insert.

50. The golf club head of claim 24, wherein said insert includes at least one secondary insert therein.

51. The golf club head of claim 50, wherein said at least one secondary insert is a weight member.

52. The golf club head of claim 50, wherein said at least one secondary insert is positioned in a central portion of said insert.

53. The golf club head of claim 50, wherein said insert includes:

a first secondary insert in a heel portion of said insert; and a second secondary insert in a toe portion of said insert.

54. The golf club head of claim 53, wherein said first secondary insert has a first mass and said second secondary insert has a second mass, and said first mass is greater than said second mass.

55. The golf club head of claim 53, wherein said first secondary insert has a first mass and said second secondary insert has a second mass, and said first mass is less than said second mass.

56. The golf club head of claim 53, wherein said first secondary insert has a first mass and said second secondary insert has a second mass, and said first mass is substantially equal to said second mass.

57. The golf club head of claim 24, wherein said insert is a multilayer insert and includes:

a first insert layer of a first material having a first stiffness, said first insert layer being coupled to a rear side of said face; and a second insert layer of a second material having a second stiffness, said second insert layer being coupled to said first insert layer.

58. The golf club head of claim 57, wherein said second insert layer is coupled to a top portion of said first insert layer.

59. The golf club head of claim 58, wherein said second insert layer contains perforations therein.

60. The golf club head of claim 59, wherein said perforations include elongated slots.

61. The golf club head of claim 60, wherein said elongated slots are substantially parallel to a longitudinal axis of the golf club head.

62. The golf club head of claim 60, wherein said elongated slots are substantially perpendicular to a longitudinal axis of the golf club head.

63. The golf club head of claim 59, wherein said first insert layer is of a first color, said second insert layer is of a second color, and said first and second colors are substantially different.

64. The golf club head of claim 57, wherein said first stiffness is less than said second stiffness.

65. The golf club head of claim 57, wherein said first stiffness is greater than said second stiffness.

66. The golf club head of claim 24, wherein said lower portion is substantially hollow.

67. The golf club head of claim 24, wherein:

said upper portion has a first volume;

said lower portion has a second volume; and said first volume is less than said second volume.

68. The golf club head of claim 67, wherein said second volume is at least two times said first volume.

69. The golf club head of claim 67, wherein:

said first volume is from approximately 0.1 $in^3$ to approximately 0.2 $in^3$; and said second volume is from approximately 0.1 $in^3$ to approximately 0.4 $in^3$.

70. The golf club head of claim 69, wherein:

said first volume is from approximately 0.14 $in^3$ to approximately 0.15 $in^3$; and said second volume is from approximately 0.15 $in^3$ to approximately 0.25 $in^3$.

71. The golf club head of claim 24, wherein said upper volume contains a ledge at a lower boundary thereof and said insert rests upon said ledge.

72. The A golf club head, comprising:

a body defining a striking face, a top line, a sole, a back, a heel, and a toe; wherein:

said back contains a cavity and a recess, said cavity extending in a direction substantially perpendicular to said face, said recess extending away from said cavity and toward said sole; and an insert positioned within said recess;

wherein said recess includes a heel portion including a first width, a toe portion including a second width, and a central portion intermediate said heel and toe portions including a third width;

wherein said third width is greater than said first and second widths;

wherein said recess includes an upper portion and a lower portion, and said insert is positioned within said upper portion; and wherein the club head has a center of gravity and a moment of inertia measured about a vertical axis passing through said center of gravity greater than approximately 2300 $gm \cdot cm^2$.

73. The golf club head of claim 72, wherein said moment of inertia is from approximately 2300 $gm \cdot cm^2$ to approximately 3000 $gm \cdot cm^2$.

* * * * *